US008893524B1

(12) United States Patent
Archer et al.

(10) Patent No.: US 8,893,524 B1
(45) Date of Patent: Nov. 25, 2014

(54) DRY ICE CONTAINER

(71) Applicants: John D. Archer, Sandy, UT (US); Charlotte Archer, Sandy, UT (US)

(72) Inventors: John D. Archer, Sandy, UT (US); Charlotte Archer, Sandy, UT (US)

( * ) Notice: Subject to any disclaimer, the term of this patent is extended or adjusted under 35 U.S.C. 154(b) by 0 days.

(21) Appl. No.: 14/159,138

(22) Filed: Jan. 20, 2014

Related U.S. Application Data

(60) Provisional application No. 61/902,478, filed on Nov. 11, 2013.

(51) Int. Cl.
*F25D 3/08* (2006.01)
*F25D 3/12* (2006.01)

(52) U.S. Cl.
CPC ..... *F25D 3/125* (2013.01)
USPC ..... 62/457.2

(58) Field of Classification Search
CPC ..... F25D 3/12; F25D 3/14; F25D 3/125; F25D 3/08
USPC ..... 62/385, 388, 371, 457.1–457.7, 465
See application file for complete search history.

(56) References Cited

U.S. PATENT DOCUMENTS

| | | | | |
|---|---|---|---|---|
| 2,071,303 A | | 2/1937 | Hill | |
| 2,632,311 A | | 3/1953 | Sullivan | |
| 3,800,554 A | | 4/1974 | Knapp et al. | |
| 3,922,878 A | * | 12/1975 | Jalali (Karchay) | 62/384 |
| 3,971,231 A | * | 7/1976 | Derry | 62/388 |
| 4,134,276 A | * | 1/1979 | Lampard | 62/383 |
| 4,195,491 A | * | 4/1980 | Roncaglione | 62/384 |
| 4,206,616 A | | 6/1980 | Frank et al. | |
| 6,212,901 B1 | | 4/2001 | Pint et al. | |
| 6,295,830 B1 | | 10/2001 | Newman | |
| 6,935,133 B2 | * | 8/2005 | Keeter et al. | 62/371 |
| 7,213,300 B1 | * | 5/2007 | Domenig et al. | 16/236 |
| 7,975,504 B2 | | 7/2011 | Whewell, Jr. | |
| 2010/0154454 A1 | * | 6/2010 | Blackstone | 62/259.3 |
| 2012/0255319 A1 | * | 10/2012 | Itoh et al. | 62/160 |

FOREIGN PATENT DOCUMENTS

JP 01254584 A * 10/1989 ..... B65D 81/38

* cited by examiner

*Primary Examiner* — Frantz Jules
*Assistant Examiner* — Emmanuel Duke
(74) *Attorney, Agent, or Firm* — Robert C. Montgomery; Montgomery Patent & Design

(57) ABSTRACT

A container assembly that is adapted to retain an amount of dry ice therein and be disposed within a cooler as a cooling source is provided. The container assembly includes a base and a lid assembly that seal together to provide an inner space to receive the dry ice. The container also includes an attached valve assembly and an outlet hose. The valve assembly is disposed on a side surface of the container to allow for an outflow of carbon dioxide gas produced by the dry ice within the container assembly. The hose is attached to the valve and fastened at its end to an inside surface of the cooler providing a flow of cold carbon dioxide gas to the interior of the cooler as the dry ice sublimates.

2 Claims, 6 Drawing Sheets

DRY ICE CONTAINER

RELATED APPLICATIONS

The present invention was first described in and claims the benefit of U.S. Provisional Application No. 61/902,478, filed Nov. 11, 2013, the entire disclosures of which are incorporated herein by reference.

FIELD OF THE INVENTION

The present invention relates generally to a container particularly suited to retain an amount of dry ice having a compartment with a valve assembly and a vent hose and configured for placement in a cooler as the cooling source.

BACKGROUND OF THE INVENTION

Spending time in the great outdoors is among the most popular fair weather leisure time activities. Whether it is fishing, camping, at a picnic or having a cookout, a great deal of time is spent preparing and consuming a meal. A common piece of equipment common to all of these activities is an insulated cooler that keeps food and beverages cold in the same manner a refrigerator does. While these coolers do an admirable job of keeping food cold, they do require periodic replenishment of ice on a very frequent basis. Many people turn to the use of dry ice to allow for longer time periods between ice replenishment, and to provide for colder temperatures. However, such ice needs to be separated or insulated from the cooler as well as the stored food, or damage to either as a result of the very cold temperatures will result. Additionally, since the dry ice "melts" directly into carbon dioxide, it must be provided with a way to leave the cooler, or an over pressurization condition can result. Further, an excessive build-up of carbon dioxide gas within the cooler may affect the taste of the foods stored within. Accordingly, there exists a need for a means by which dry ice can be used in a cooler to keep food cold, but without the disadvantages as described above.

SUMMARY OF THE INVENTION

The disadvantages of the prior art are overcome by the present invention in providing a container assembly that is adapted to retain an amount of dry ice therein and be disposed within a cooler as a cooling source. The container assembly includes a base and a lid assembly that seal together to provide an inner space to receive the dry ice. The container also includes an attached valve assembly and a vent hose. The valve assembly is disposed on a side surface of the container to allow for an outflow of carbon dioxide gas produced by the dry ice within the container assembly. The hose is attached to the valve and fastened at its end to an inside surface of the cooler providing a flow of cold carbon dioxide gas to the interior of the cooler as the dry ice sublimates. The use of the present invention provides the ability to utilize dry ice as a means to keep food cold, but without any of the conventional problems normally associated with dry ice use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
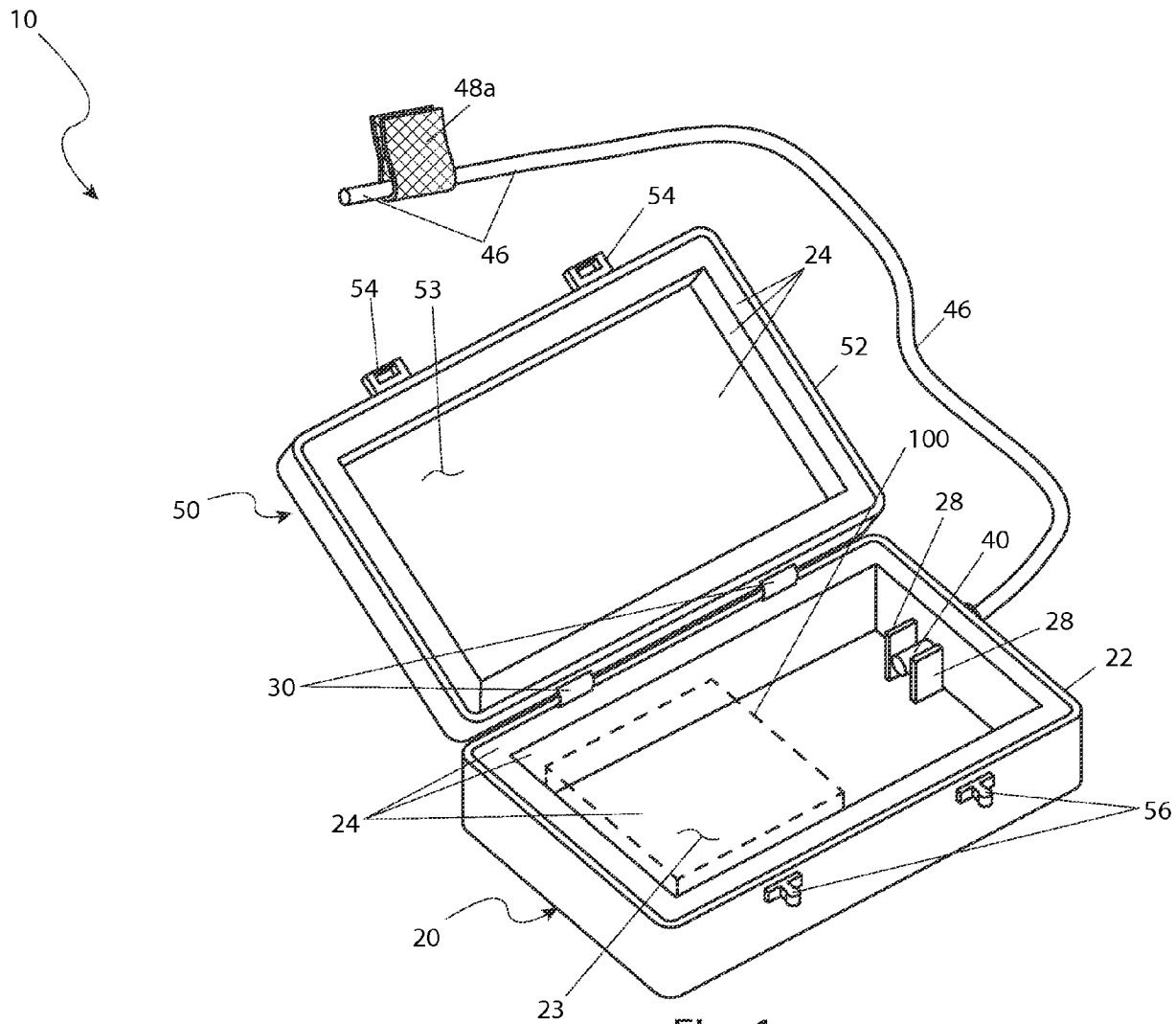
FIG. 1 is a left side perspective view of a dry ice container 10, according to a preferred embodiment of the present invention.

10 dry ice container
20 base assembly
22 base enclosure
23 base inner space
24 insulation
28 dam structure
30 hinge
40 outlet tube
42 check valve
44 hose connector
45 carbon dioxide (CO2) gas
46 cold CO2 output hose
48*a* fastener
48*b* fastener
50 lid assembly
52 lid enclosure
53 lid inner space
54 latch
56 catch
100 dry ice
105 ice chest
200 first alternate embodiment
220 base assembly
222 base enclosure
224 latch
226 latch pivot feature
250 lid assembly
252 lid enclosure
254 catch
300 third alternate embodiment
320 base assembly
322 base enclosure
324 auxiliary port
326 auxiliary hose connector
328 auxiliary hose
330 cap

DETAILED DESCRIPTION OF THE PREFERRED EMBODIMENT

Figure 2:
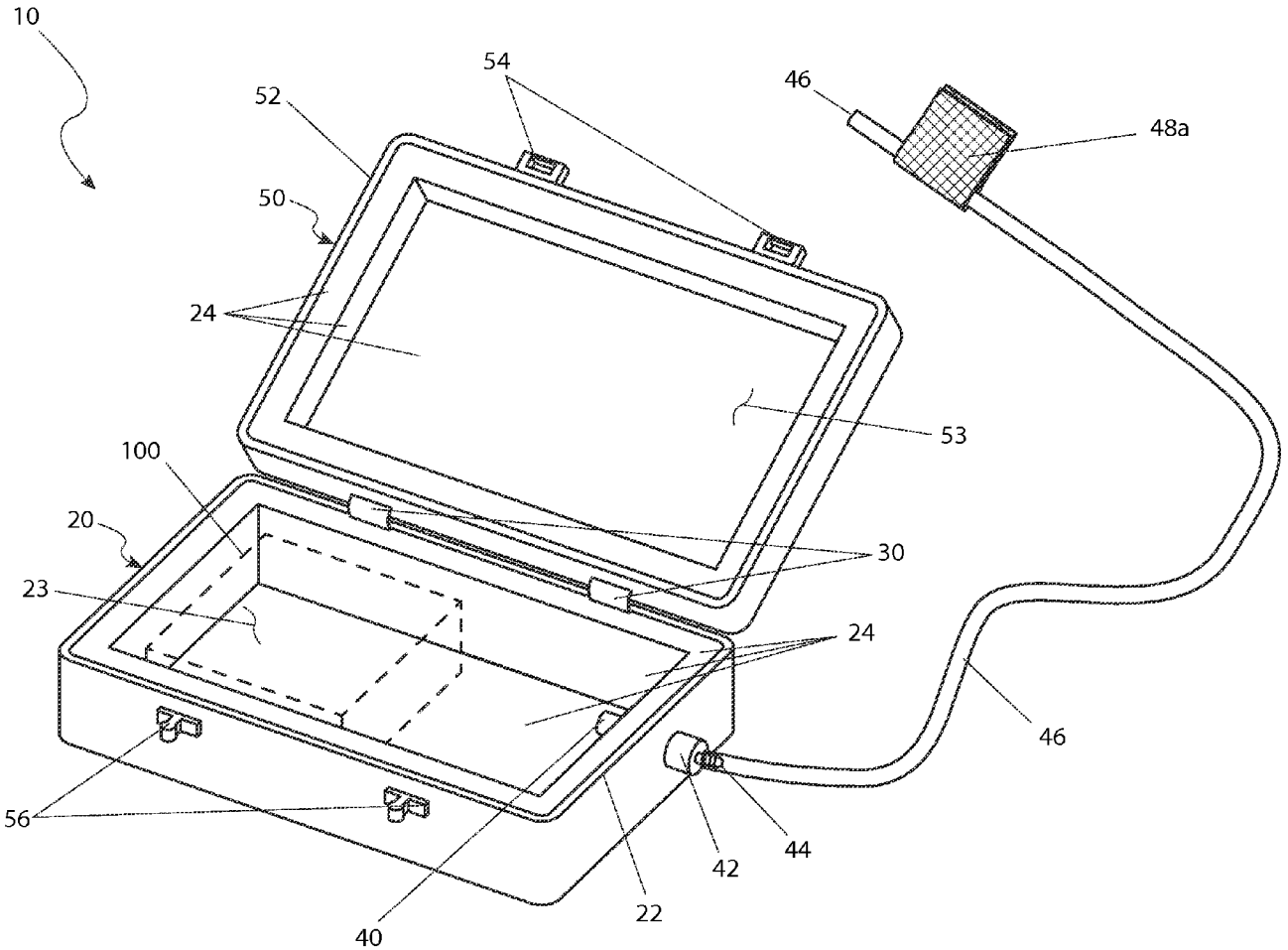
FIG. 2 is a right side perspective view of a dry ice container 10, according to a preferred embodiment of the present invention.
Figure 3:
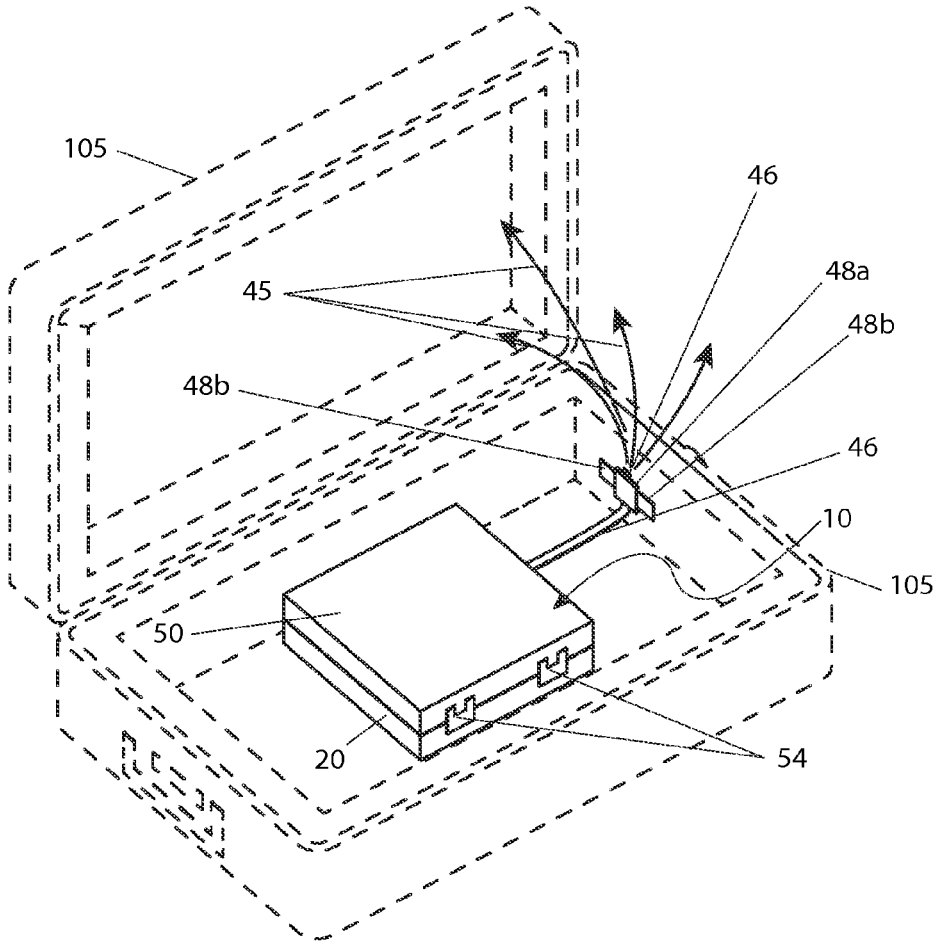
FIG. 3 is an environmental view of the dry ice container 10, according to a preferred embodiment of the present invention.
Figure 4:
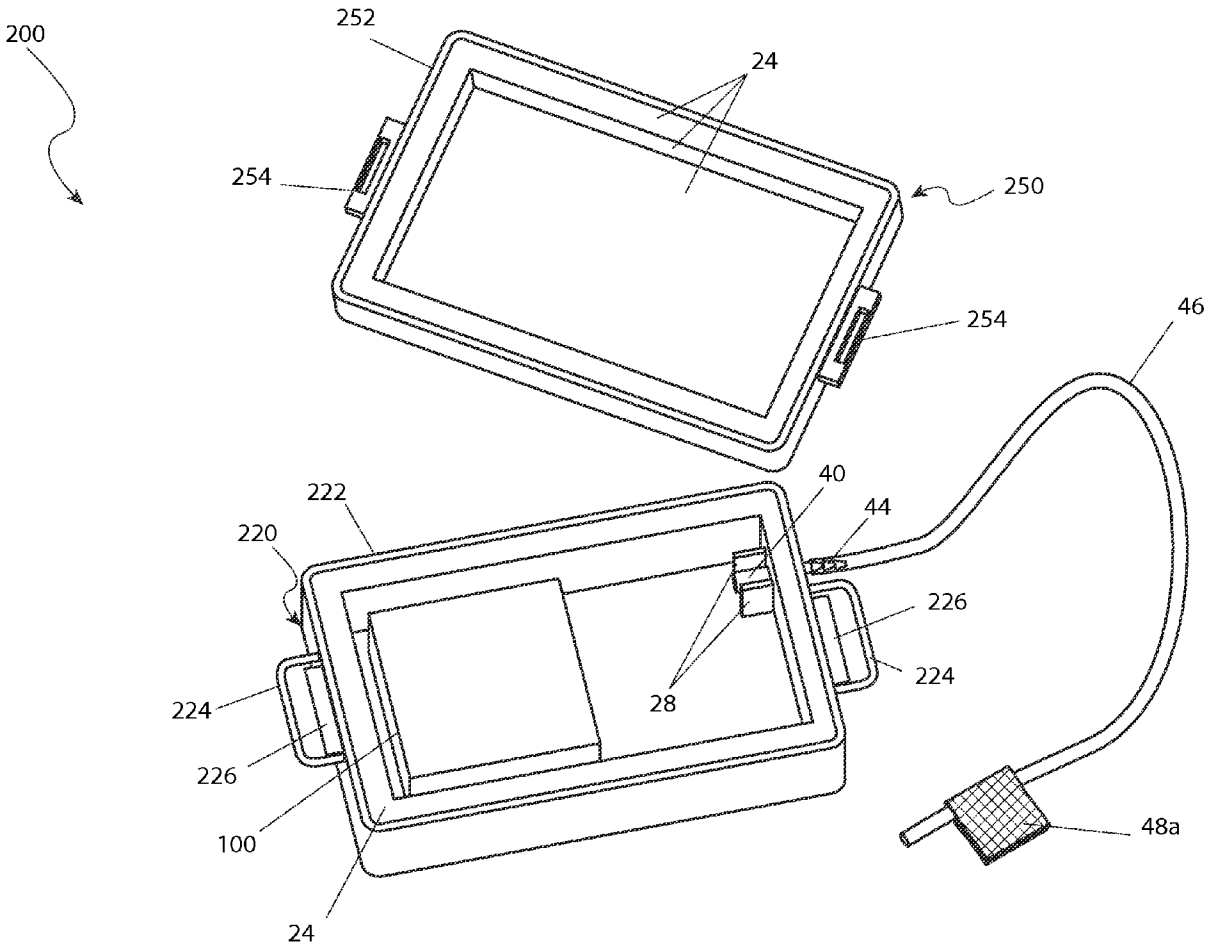
FIG. 4 is a perspective view of a first alternate embodiment 200 of the invention depicting a detachable lid portion 250.
Figure 5:
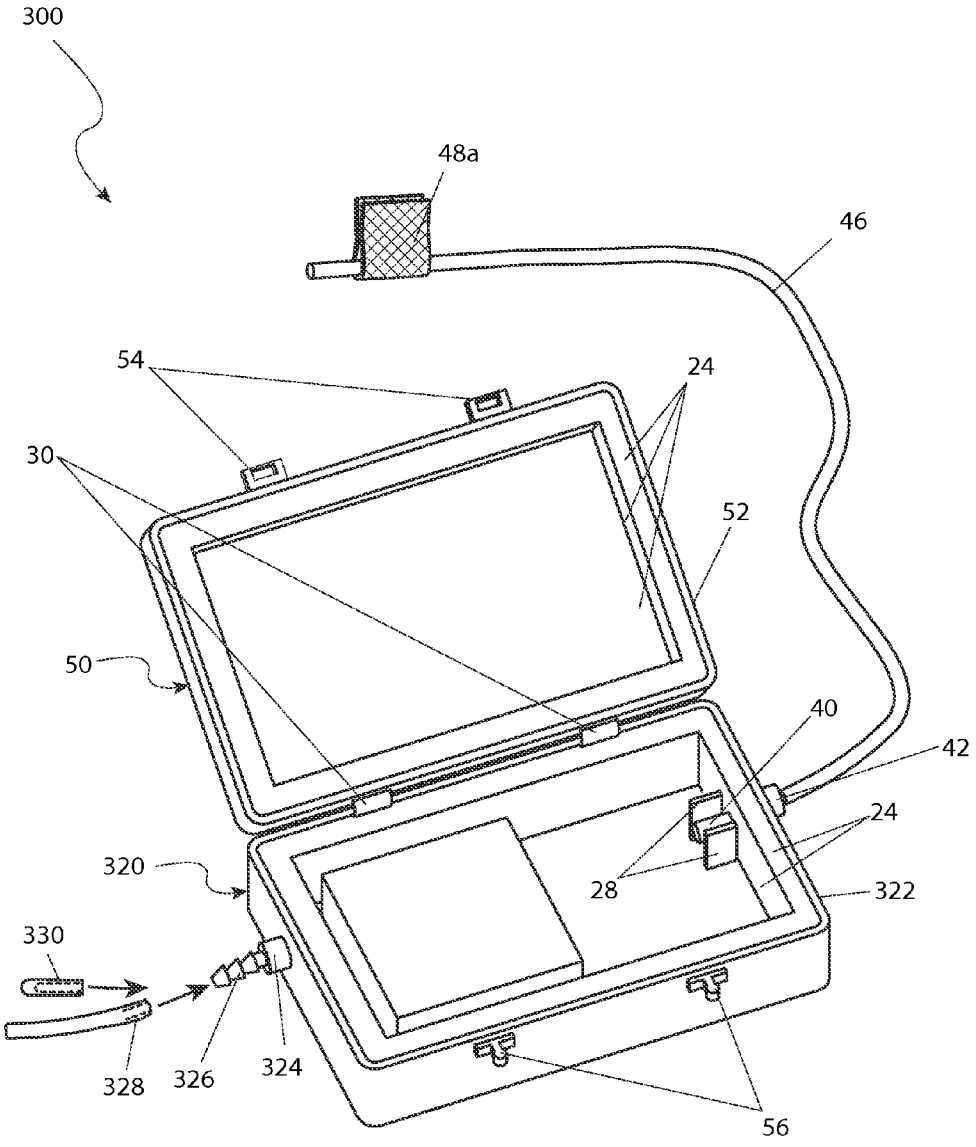
FIG. 5 is a perspective view of a second alternate embodiment 300 of the invention depicting an auxiliary hose connector portion 326; and, FIG. 6 is a perspective view of a second alternate embodiment 300 being connected to another unit 300 via the auxiliary port 324 of each unit 300.

The best mode for carrying out the invention is presented in terms of its preferred embodiment, herein depicted within FIGS. 1 through 3, and in terms of alternate embodiments, herein depicted in FIGS. 4 and 5. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The present invention describes a dry ice container (herein described as the "apparatus") 10, which provides an enclosure that holds dry ice 100 to provide improved cooling within a portable cooler 105. The apparatus 10 includes a plastic insulated enclosure being both airtight and watertight and having a outlet hose 46 which delivers cold carbon dioxide ($CO_2$) gas 45 to an interior space within the cooler 105 to keep foodstuffs cold as the dry ice 100 sublimates.

Referring now to FIGS. 1 and 2, perspective views of the apparatus 10, according to the preferred embodiment of the present invention, are disclosed. The apparatus 10 includes of a two-part plastic enclosure made up of a base assembly 20 and a lid assembly 50. The base assembly 20 includes a bottom and four (4) enclosing sidewalls to form a base enclosure 22 about a base interior space 23. The lid assembly 50 also having four enclosing sidewalls to form a lid enclosure 52 about a lid inner space 53. The base enclosure 22 and lid enclosure 52 are formed to have cooperative mating upper and lower edge portions, respectively, and seal to each other when the lid assembly 50 is closed. The base assembly 20 and lid assembly 50 are connected to each other along one (1) edge via a pair of hinges 30. Opposite the hinges 30, a pair of latches 54 and corresponding catches 56 are utilized to close and secure the lid assembly 50 to the base assembly 20. The hinges 30 are preferably a pair of integrally-molded members spanning a gap between the base assembly 20 and a first lid assembly 50 portions. It should be appreciated however, that without limitation, other types of hinges 30 may be utilized, such as axial type, or a slidable pin type that would allow the lid assembly 50 to be detached from the base assembly 20 without deviating from the teachings of the invention.

The base assembly 20 and lid assembly 50 are to provide an airtight and watertight structure when closed and latched and having respective base inner space 23 and lid inner space 53 portions to contain the dry ice 100. The base enclosure 22 and base enclosure 52 portions are to be made using a durable plastic material such as polypropylene, high impact polystyrene, acrylonitrile butadiene styrene, or the like, capable of sub-zero temperatures, envisioned to be made in an injection molding process. Said inner spaces 23, 53 are to be lined along side and bottom surfaces with an insulation material 24 such as polystyrene or equivalent insulating material, being adhesively affixed thereto and being approximately one-eighth of an inch (½ in.) in thickness. The insulation 24 is envisioned to provide thermal protection to food stuffs within the cooler 105, and the enclosure portions 22, 52. The insulation 24 acts to prolong the vaporizing processes of the dry ice 100, thereby enabling the apparatus 10 to cool the cooler 105 for an extended period of time without the use of conventional ice or ice packs.

It is understood that the exact size of the apparatus 10 may vary based upon a correspond size of the cooler 105 into which the apparatus 10 is to be inserted, but is envisioned to be generally rectangular in shape. It is further envisioned that an embodiment of the apparatus 10 may be used to transport and deliver medical materials which require refrigeration, in which case the aforementioned base enclosure 22 and lid enclosure 52 portions are envisioned being made using a polished metal material such as stainless steel or equivalent, being suitable for associated disinfecting processes.

The apparatus 10 is provided with a gas outlet tube 40 having an in-line gas check valve 42 to protect the interior portions of the apparatus 10 from contamination while providing a one-way outward flow of $CO_2$ gas 45 from the apparatus 10 as the dry ice 100 sublimates over time. The gas outlet tube 40 protrudes slightly into the base inner space 23 and is protected from possible clogging by a pair of interior barrier dam structures 28 being rectangular in shape and integrally-molded into the base enclosure 22. The barrier dam structures 28 are positioned adjacent to and at either side of the gas outlet tube 40. The gas outlet tube 40 and integral gas check valve 42 are envisioned to be integrally-molded into a side wall portion of the first base enclosure 22, or otherwise fastened and sealed thereto. The gas check valve 42 further includes an integral barbed hose connector 44 which provides removable attachment of a proximal end of a cold CO2 outlet hose 46. The cold CO2 outlet hose 46 is to comprise a section of one-quarter inch (¼ in.) diameter rubber hose having a distal end which includes an adhesively affixed first fastener **48*a*. The fastener 48*a* is envisioned to be a hook-and-loop fastening means such as VELCRO®. When installed within the cooler 105, the distal end of the outlet hose 46 and the securing fastener 48*a* are positioned at an upper edge portion of the cooler 105 (see FIG. 3**).

Referring now to FIG. 3, an environmental view of the apparatus 10, according to the preferred embodiment of the present invention, is disclosed. The apparatus 10 is envisioned being placed within a cooler 105 preferably below subsequently loaded food stuffs to provide extended cooling. The cold $CO_2$ hose 46 is affixed to the hose connector 44 and protrudes from a side surface of the apparatus 10, being routed upwardly along an adjacent side surface of the cooler 105 via the fastener **48*a* and a fastener 48*b*. The fasteners 48*a*, 48*b* are envisioned to be hook-and-loop type devices such as VELCRO®, or the like. The fastener portion 48*a* is envisioned to be adhesively affixed to the cold CO2 hose 46 and is to be secured to an inner wall portion of the cooler 105 via attachment to the corresponding fastener 48*b*, having been pre-applied to the inner wall of the cooler 105. The described arrangement of the cold $CO_2$ hose 46 prevents any possible blockage of an open end portion of the cold $CO_2$ hose 46 by food stuffs, melted ice, or other items within the cooler 105 which may interfere with the flow of the $CO_2$ gas 45**.

Referring now to FIG. 4, a perspective view of a first alternate embodiment 200 of the invention depicting a detachable lid portion 250, is disclosed. The invention may be introduced having an alternate second base assembly 220 having features which provide removable attachment of a second lid assembly 250. The first alternate embodiment 200 comprises similar materials, overall shape and size, as well as airtight and watertight sealing of the dry ice 100 within, as the previously described preferred embodiment of the apparatus 10. Additionally, the base assembly 220 and lid assembly 250 include respective latch 224 and catch 254 portions along opposing short side portions to seal the base assembly 220 and lid assembly 250 together. The second latches 224 comprise "U"-shaped members being rotatingly secured to the base assembly 220 via respective latch pivot features 226. The latch pivot features 226 are envisioned being integrally-molded into the base enclosure 222. The latches 224 provide engaging entrapment of the molded-in and stationary catches 254 of the corresponding lid assembly 250.

Figure 6:
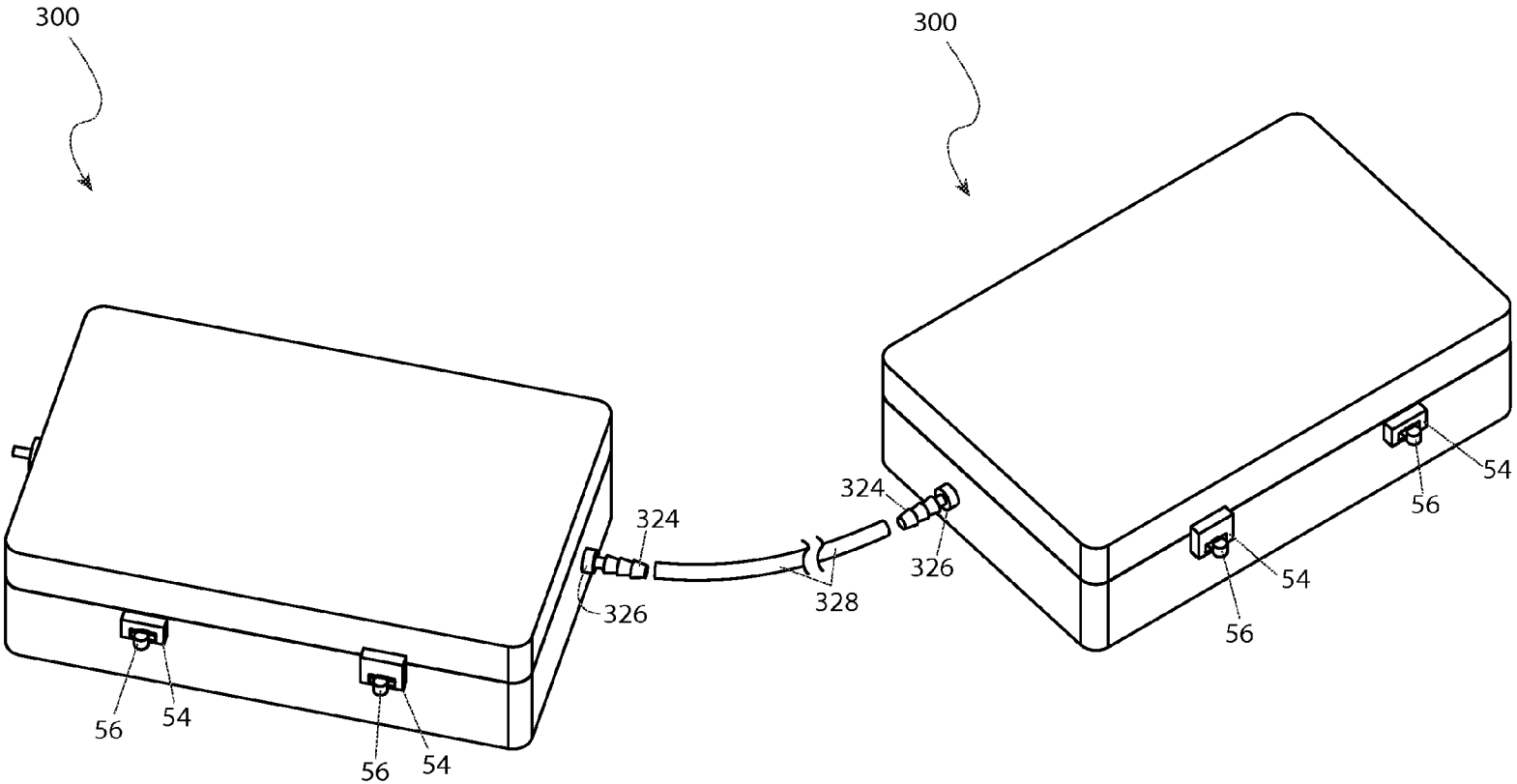

Referring now to FIG. 5 and FIG. 6, a perspective view of a second alternate embodiment 300 of the invention depicting attachment of an auxiliary hose connector portion 326 and a perspective view of a second alternate embodiment 300 being connected to another unit 300 via the auxiliary port 324 of each unit 300, are disclosed. The second alternate embodiment 300 comprises similar materials, construction, and function as the preferred embodiment of the apparatus 10;

however, the second alternate provides a means to establish fluid communication between a plurality of dry ice container embodiments 10, 300 via an auxiliary port 324 preferably located along a side surface opposite the outlet tube 40. The auxiliary port 324 comprises a fluid conduit means being integrated into the side portion of the second alternate embodiment 300 further comprising an integral barbed auxiliary hose connector 326 which provides attachment of an auxiliary hose 328. In use, the auxiliary hose 328 is routed and connected to a hose connector portion 44 of a unit of the preferred apparatus 10, or to another second alternate embodiment 300, thereby joining a desired number of adjacent units 10, 300 together. By combining a plurality of dry ice containers 10, 300 together, a user can direct an increased and variable flow of cold $CO_2$ gas 45 into the cooler 105 based upon a size of the cooler 105, or to obtain a colder temperature within the cooler 105.

The second alternate embodiment 300 includes a cap 330 to plug the auxiliary hose connector 326 when not in use, thereby enabling the second alternate embodiment 300 to function in a similar manner as the preferred embodiment of the apparatus 10, if desired. It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 3. The method of installing and utilizing the apparatus 10 may be achieved by performing the following steps: procuring the apparatus 10; placing the container assembly 10 within the cooler 105; attaching the outlet hose 46 (by way of the fasteners 48*a* and 48*b*) to an inner surface of the cooler 105; opening the lid assembly 50 of the container assembly 10; placing a appropriate portion of dry ice into the base inner space 23; closing and sealing the lid assembly 50 by fastening the latches 50 to the catches 56 thereby directing an outflow of $CO_2$ gas from the valve 42 and the hose 46 into the cooler 105; loading any number or quantity of food stuff items and other items in the cooler 105 as desired; and, benefiting from a flow of cold $CO_2$ gas 45 from the apparatus 10 into the cooler 105 for an extended period of time to keep food stuffs within an cooler 105 cold.

The first alternate embodiment 200 would be utilized in a similar manner as the preferred apparatus 10 while allowing complete detachment of the removable second lid assembly 250 during loading of the dry ice 100 within. The method of configuring and utilizing a combination of preferred embodiments 10 and second alternate embodiments 300 may be achieved by performing the following steps: procuring a desired number of preferred embodiments 10 and second alternate embodiments 300 based upon a particularly sized cooler 105 and/or a desired internal temperature to be obtained within the cooler 105; connecting the embodiments 10, 300 together in a series manner using the auxiliary hoses 328, the auxiliary ports 324, and, as needed, a cap 330 upon any unused auxiliary hose connector 326; arranging the connected embodiments of the invention 10, 300 as desired along a bottom surface of the cooler 105; loading food stuffs into the cooler 105; and, utilizing the cooler 105 as previously described for the preferred apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A container assembly adapted to be disposed within a cooler, comprising:

a base assembly having a bottom and four enclosing sidewalls to form a base enclosure about a base interior space; a lid assembly hingedly attached to said base assembly and having four enclosing sidewalls to form a lid enclosure about a lid inner space, said lid assembly is hingedly attached by at least one hinge having a slideable pin to allow said lid assembly to be operatively detached from said base assembly; at least one latch disposed on said base assembly and at least one corresponding catch disposed on said lid assembly that operatively connect and seal said lid assembly to said base assembly; an outlet tube disposed on said base assembly; an outlet hose operatively connected to said outlet tube and having a portion of said tube extending from said outlet tube and removably affixed to a surface of an interior of said cooler; a set of complementary hook and loop fasteners configured to removably affix said outlet hose to said interior of said cooler; a check valve operatively disposed between said outlet tube and said outlet hose; a pair of barrier dam structures formed in said base enclosure adjacent said outlet tube to prevent dry ice from blocking an outflow of carbon dioxide gas to said tube; an auxiliary port and a sealing cap disposed upon an inlet of said auxiliary port, said sealing cap is configured to operatively prevent the outflow of said carbon dioxide gas from said auxiliary port; and, an inlet hose, wherein said inlet hose is disposed on said auxiliary port and is in fluid communication with an auxiliary port of a second container assembly thereby linking said container assembly to said second container assembly to provide an additional cooling source to said cooler; wherein said base enclosure and said lid enclosure are adapted to receive and retain an amount of dry ice therein and seal to each other when said base and said lid assemblies are closed, and; wherein said outlet tube allows for the outflow of carbon dioxide gas produced by said dry ice within said container assembly to enter said cooler as a cooling media for said cooler.

2. A container assembly adapted to retain an amount of dry ice therein, comprises: a base assembly having a bottom and four enclosing sidewalls to form a base enclosure about a base interior space; a lid assembly having four enclosing sidewalls to form a lid enclosure about a lid inner space; at least one hinge, each hinge configured to operatively connect said base assembly to said lid assembly along a concomitant edge, wherein at least one of said hinge comprises a slideable pin to allow said lid assembly to be operatively detached from said base assembly; at least one latch disposed on said base assembly and at least one corresponding catch disposed on said lid assembly that operatively connect and seal said lid assembly to said base assembly; an outlet tube disposed in said base assembly; an outlet hose operatively connected to said outlet tube and having a portion of said tube extending from said outlet tube and removably affixed to a surface of an interior of a cooler; a set of complementary hook and loop fasteners configured to removably affix said outlet hose to said interior of said cooler; a check valve operatively disposed between said outlet tube and said outlet hose; a pair of barrier dam structures formed in said base enclosure adjacent said outlet tube to prevent said dry ice from blocking an outflow of carbon dioxide gas to said tube; an auxiliary port and a sealing cap disposed upon an inlet of said auxiliary port, said sealing cap is configured to operatively prevent the outflow of said carbon dioxide gas from said auxiliary port; and, an inlet hose, wherein said inlet hose is disposed on said auxiliary port and is in fluid communication with an auxiliary port of a second container assembly thereby linking said container assembly to said second container assembly to provide an additional cooling source to said cooler; wherein said base enclosure and said lid enclosure are formed to have cooperative lower and upper edge mating portions, respectively, that seal to each other when said base and said lid assemblies are closed; wherein said base inner space and said lid inner space receive and retain said dry ice; wherein said outlet tube allows for the outflow of carbon dioxide gas produced by said dry ice within said container assembly, and; wherein said container assembly is adapted to be placed within the cooler and said outflow of carbon dioxide gas through said tube acts as a cooling media for said cooler.

* * * * *